US010407790B1

(12) United States Patent
Johannes et al.

(10) Patent No.: US 10,407,790 B1
(45) Date of Patent: Sep. 10, 2019

(54) METHOD OF ELECTROCHEMICALLY-DRIVEN COATED MATERIAL SYNTHESIS

(71) Applicant: The Government of the United States of America, as represented by the Secretary of the Navy, Arlington, VA (US)

(72) Inventors: Andrew C. Johannes, Stillwater, OK (US); Sebastian Osswald, Verl (DE)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 211 days.

(21) Appl. No.: 15/375,279

(22) Filed: Dec. 12, 2016

Related U.S. Application Data

(63) Continuation-in-part of application No. 14/665,865, filed on Mar. 23, 2015, now abandoned.

(51) Int. Cl.
*C25D 7/00* (2006.01)
*C25D 5/08* (2006.01)
(Continued)

(52) U.S. Cl.
CPC ..... *C25D 7/006* (2013.01); *C25D 5/08* (2013.01); *C25D 17/16* (2013.01); *C25D 21/10* (2013.01)

(58) Field of Classification Search
CPC ..... C25D 7/006
(Continued)

(56) References Cited

U.S. PATENT DOCUMENTS

H36 H * 3/1986 Smith ..... 204/234
5,039,338 A * 8/1991 Kondo ..... C23C 18/405 106/1.18
(Continued)

FOREIGN PATENT DOCUMENTS

WO WO-2012110875 A2 * 8/2012 ..... C25D 7/006

OTHER PUBLICATIONS

Johannes, Letting Corrosion Work for You: Novel Pathways to Additive Manufacturing and Nanomaterial Synthesis Using Electrochemically-Driven Powder Consolidation, Advanced Engineering Materials, 2014, 16, No. 9 pp. 1147-1159 (Year: 2014).*
(Continued)

*Primary Examiner* — Tabatha L Penny
(74) *Attorney, Agent, or Firm* — Naval Postgraduate School; Lisa A. Norris; James B. Potts

(57) ABSTRACT

Provided here is a method for providing a coating on a plurality of substrate particles utilizing concurrent dissolution and deposition processes occurring among a plurality of source particles. Both the plurality of source particles and the plurality of substrate particles are freely immersed in the aqueous solution to form a slurry. A pH of the aqueous solution the electrochemical potential between the plurality of source particles and the aqueous solution establishes the source particles at a corrosion potential providing the concurrent dissolution and re-deposition of a cationic species on the source particles. Agitation of the slurry generates close proximity and/or brief contact between source and substrate particles causing substrate particles pass through the local environment of the source particles, resulting in some portion of the cationic species depositing at nucleation sites on the substrate particles.

14 Claims, 3 Drawing Sheets

(51) Int. Cl.
*C25D 17/16* (2006.01)
*C25D 21/10* (2006.01)
(58) Field of Classification Search
USPC ..... 427/212
See application file for complete search history.

(56) References Cited

U.S. PATENT DOCUMENTS

| | | | | |
|---|---|---|---|---|
| 6,596,224 | B1 | 7/2003 | Sachs | |
| 9,248,501 | B1 * | 2/2016 | Johannes | B22F 1/0096 |
| 2009/0202904 | A1 | 8/2009 | Genc | |
| 2012/0217165 | A1 * | 8/2012 | Feng | C25D 5/022 205/135 |
| 2015/0080495 | A1 | 3/2015 | Heikkila | |
| 2015/0135897 | A1 | 5/2015 | Sutcliffe | |

OTHER PUBLICATIONS

Muste, et al. "Two-phase flow insights into open-channel flows with suspended particles of different densities" Environmental Fluid Mechanics 9, 2009, pp. 161-186.
Sharma, et al. "Spark plasma sintering of nanocrystalline Cu and Cu-10 wt pct Pb alloy" Metall. Mater. Trans. A-Phys. Metall. Mater. Sci. 42A, 2011, 2072-2084.
Perez-Maqueda, et al. "Effect of sonication on particle-size distribution in natural muscovite and biotite" Clays and Clay Minerals 51, 2003, 701-708.
Melchoir, et al. "Solar-driven biochar gasification in a particle-flow reactor" Chem. Eng. Process. 48, 2009, pp. 1279-1287.
McFadyen, et al. "High-resolution particle-size analysis from nanometers to microns" Clay Minerals 28, 1993, pp. 531-537.
Paul, et al. "Issues in fabricating manufacturing tooling using powder-based additive freeform fabrication" Journal of Materials Processing Technology 61, 1996, pp. 168-172.
Farmer, et al. "Effect of Rhodamine-B on the Electrodeposition of Lead on Copper" Journal of the Electrochemical Society 132, 1985, pp. 313-319.
Zhao, et al. "A novel sintering-dissolution process for manufacturing Al foams" Scripta Materialia 44, 2001, pp.105-110.
Barg, et al. "Novel open cell aluminum foams and their use as reactive support for zeolite crystallization" Journal of Porous Materials 18, 2011, pp. 89-98.
Rat'ko, et al. "Hydrothermal synthesis of porous Al2O3/Al metal ceramics: II. Mechanism of formation of a porous Al (OH)(3)/Al composite" Kinetics and Catalysis 45, 2004, pp. 149-155.
Barkey, et al. "Kinetic anisotropy and dendritic growth in electrochemical deposition" Phys. Rev. Lett. 75, 1995, pp. 2980-2983.
Shchekin, et al. "Generalization of the Gibbs-Kelvin-Kohler and Ostwald—Freundlich equations for a liquid film on a soluble nanoparticle" The Journal of Chemical Physics 129, 2008, pp. 154116-154115.
Ordal, et al. "Optical properties of 14 metals in the infrared and far infrared—Al, Co, Cu, Au, Fe, Pb, Mo, Ni, Pd, Pt, Ag, Ti, V and W" Appl. Optics 24, 1985, pp. 4493-4499.
Ruetshi, et al. "Self-discharge reactions in lead-acid batteries" Journal of the Electrochemical Society 105, 1958, pp. 555-563.
Vanberkum, et al. "Diffraction-line broadening due to strain fields in materials; Fundamental aspects and methods of analysis" Acta Crystallographica Section A 52, 1996, pp. 730-747.
Woo, et al. "Synthesis of nanodiamond-reinforced aluminum metal composite powders and coatings using high-energy ball milling and cold spray" Carbon 63, 2013, pp. 404-415.
Ilic, et al. "Viscosity of concentrated suspensions of spheres" Rheologica Acta 33, 1994, pp. 283-291.
Mirza. et al., "Sedimentation of suspensions of particles of two or more sizes" Chemical Engineering Science 34, 1979, pp. 447-454.
Park, et al. "Comparison of the Nernst-Planck model and the Poisson-Boltzmann model for electroosmotic flows in microchannels" Journal of Colloid and Interface Science 315, 2007, pp. 731-739.
Xie, et al. "Effects of dispersants and soluble counter-ions on aqueous dispersibility of nano-sized zirconia powder" Ceramics International 30, 2004, pp. 219-224.
Duduta, et al. "Semi-solid lithium rechargeable flow battery" Advanced Energy Materials 1, 2011, pp. 511-516.
Ho, et al. "Modelling of micro-particle agglomeration in turbulent flows" Chemical Engineering Science 57, 2002, pp. 3073-3084.
Blum, J. "Grain growth and coagulation" Astrophysics of Dust, ASP Conference Series 309, 2003, pp. 24.
Segets, et al. "Experimental and Theoretical Studies of the Colloidal Stability of Nanoparticles—A General Interpretation Based on Stability Maps" ACS Nano 5, 2011, pp. 4658-4669.
Kang, et al. "Fluctuation Effects in Smoluchowski Reaction-Kinetics" Physical Review A 30, 1984, pp. 2833-2836.
Heine, et al. "High concentration agglomerate dynamics at high temperatures" Langmuir 22, 2006, pp. 10238-10245.
Wattis, et al. "Exact solutions for cluster-growth kinetics with evolving size and shape profiles" J. Phys. A-Math. Gen. 39, 2006., pp. 7283-7298.
Kim, et al. "Improved orthokinetic coagulation model for fractal colloids: Aggregation and breakup" Chemical Engineering Science 61, 2006, pp. 45-53.
Cannone, et al. "Comments on the evaluation of valve regulated lead-acid batteries (VRLA) under deep cycling regimes" 1998.
Kirchev, et al. "Carbon honeycomb grids for advanced lead-acid batteries. Part I: Proof of concept" J. Power Sources 196, 2011, pp. 8773-8788.
Flagan, R. C. "Dynamics of pyrogenous fumes" Fuel Process. Technol. 39, 1994, pp. 319-336.
Andal, et al. "Synthesis of nano CuO by polymeric precursor method and its low temperature reduction to stable copper nanoparticles" J. Nano Res. 15, 2011, pp. 11-20.
Danel, et al. "Study of Pb(II) in various H2O-H2SO4 mixtures by differential pulse polarography: Solubility of lead sulfate, diffusion-coefficient of Pb(II) and half-wave potential of Pb(Hg)/Pb(II)" Electrochim. Acta 27, 1982, pp. 771-774.
Foller, P. C. "Improved slurry zinc/air systems as batteries for urban vehicle propulsion" J. Appl. Electrochem. 16, 1986, pp. 527-543.
De Yoreo, et al. "Principles of crystal nucleation and growth" Reviews in mineralogy and geochemistry 54, 2003, pp. 57-93.
Loyalka, S.K. "Brownian coagulation of aerosols" Journal of Colloid and Interface Science 57, 1976, pp. 578-579.
Arora, et al. "Battery separators" Chemical Reviews 104, 2004, pp. 64.
Lyklema, et al. "DLVO-theory, a dynamic re-interpretation" Adv. Colloid Interface Sci. 83, 1999, pp. 33-69.
Bullock, K. R. "Lead-acid batteries" J. Power Sources 51, 1994, pp. 1-17.
Pavlov, et al. "Influence of H2SO4 concentration on the mechanism of the processes and on the electrochemical activity of the Pb/PbO2/PbSO4 electrode" J. Power Sources 137, 2004, pp. 288-308.
Marsalek, et al. "The reduction of zinc using goethite process and adsorption of Pb+2, Cu+2 and Cr+3 on selected precipitate" International Journal of Environmental Science and Development 2, 2011, pp. 255-258.
Karunakaran, et al. "Rapid manufacturing of metallic objects" Rapid Prototyping J. 18, 2012, pp. 264-280.
Chen, et al. "Hamaker-constant calculations and surface melting of metals, semimetals and semiconductors" Nuovo Cimento Della Societa Italiana Di Fisica D-Condensed Matter Atomic Molecular and Chemical Physics Fluids Plasmas Biophysics 13, 1991, pp. 926-937.
Sze, et al. "Zeta-potential measurement using the Smoluchowski equation and the slope of the current-time relationship in electroosmotic flow" Journal of Colloid and Interface Science 261, 2003, pp. 402-410.
Pavlov, et al. "Premature capacity loss (PCL) of the positive lead-acid-battery plate—a new concept to describe the phenomenon" J. Power Sources 42, 1993, pp. 345-363.
Pourbaix. "Atlas of Electrochemical Equilibria in Aqueous Solutions" J. A. Franklin Trans., Second English Edition ed.,National Association of Corrosion Engineers, 1974, p. 479.

(56) References Cited

OTHER PUBLICATIONS

Scientific, H. in HORIBA Instruments, Inc. vol. WP004 (Online: http://www.horiba.com/scientific/products/particlecharacterization/download-center/white-papers/, 2012).

* cited by examiner

METHOD OF ELECTROCHEMICALLY-DRIVEN COATED MATERIAL SYNTHESIS

RELATION TO OTHER APPLICATIONS

This patent application claims priority from nonprovisional patent application Ser. No. 14/665,865 filed Mar. 3, 2015, which claims priority from provisional patent application 62/075,354 filed Nov. 5, 2014, both of which are hereby incorporated by reference in their entirety.

FIELD OF THE INVENTION

One or more embodiments relates to relates to an method of electrochemically-driven substrate particle plating using close proximity to a plurality of source particles freely immersed in an aqueous solution and at a corrosion potential.

BACKGROUND

Current manufacturing techniques for application of coatings, for plating, or for deposition include gilding, mechanical plating, autocatalytic coating processes, such as alkaline electroless nickel boron coating, electroplating, such as chrome plating, copper plating, galvanization, such as hot-dip galvanization, tinning, and chemical and physical vapor deposition methods.

In gilding a thin film of a metal, such as gold, is coated onto a surface of a substrate such as wood, stone, or to give a thin coating of the metal. Mechanical plating is a process that applies a coating by cold welding fine metal particles to a surface of a substrate. In alkaline electroless nickel boron coating, the mixture of amorphous nickel boron is deposited from an aqueous solution which contains either an alkylamineborane or sodium borohydride as a reducing agent, a source of nickel ions, a buffer, a complexing agent, and optional control chemicals.

Electroplating is a process that uses electric current to reduce a metal cation dissolved in a solution to form a metal coating onto a cathode. Chrome plating involves electroplating a thin layer of chromium metal onto a metal or plastic surface of an object. The copper plating process involves complex systems, such as an alkaline-complexed bath, acid-complexed bath, and mildly alkaline-complexed bath. Galvanization, is a process of applying a protective zinc coating to steel or iron. Hot-dip galvanization is the process of coating an easily oxidizable metal, such as iron, steel or aluminum, with a coating of zinc by immersing the easily oxidizable metal in a bath of molten zinc.

Corrosion occurs in the presence of an electrolyte solution and involves oxidation (electron donating) and reduction (electron consuming) reactions that dissolve materials, particularly metals. In the acidic pH region, hydrogen ions ($H^+$) and dissolved oxygen ($O_2$) are the primary oxidizing agents, causing the dissolution of metals (M) according to:

$$\text{Cathodic Reactions: } 2H^+ + 2e^- \rightarrow 4\ H_2 \text{ (0 V vs. NHE)}$$

$$O_2 \pm 4\ H^+ + 4e^- \rightarrow 2H_2O \text{ (1.23 V vs NHE)}$$

$$\text{Anodic Reaction: } M \rightarrow M^{n+} + n\ e^-$$

In most cases, the dissolved metal cations ($M^{n+}$) are transported away from the surface, form salts with anions in the electrolyte, and precipitate out of the solution. Muste, M. et al. "Two-phase flow insights into open-channel flows with suspended particles of different densities," Environ. Fluid Mech. 9, 161-186 (2009). However, under certain conditions, re-deposition of the metal ions can occur.

Surface films set the surface potentials that govern the re-deposition process. In an aqueous solution, surface potentials may be controlled by surfactants, potential-control agents, such as hydrogen peroxide or vanadium oxide, or by external electric fields. In the case of lead (Pb) deposition in an acidic environment, Rhodamine B, has been employed to prevent dendrite growth during electro-deposition of Pb (see, Farmer, J. C., Muller, R. H., Effect of Rhodamine B on the Electrodeposition of Lead on Copper, J. Electrochem. Soc. 1985, 132, 313-319). As with most electrochemical processes, temperature plays an important role and directly affects reaction kinetics, fluid properties, phase changes, solubility.

Electroless plating uses a reduction agent in the process, typically formaldehydes, hydrazine, borohydrides, amine boranes, and derivatives. The ion to be deposited is added in various forms, for example, as a hydroxide or as a salt. Most processes involve replacement reactions where the element to be deposited is replaced in the precursor or within the reduction agent. This process does not rely on redox reactions or electrochemical potentials to deposit an element and thus is limited to use of specific materials.

Many of the methods of applying coatings onto a substrate surface exhibit limitations, such as cost, effectiveness, safety, etc. For example, copper is an active metal that is difficult to plate onto a passivated surface, making direct plating of iron based metals difficult. Another problem with some plating techniques is the high temperatures at which the plating occurs. Another possible disadvantage of some of the above-mentioned coating techniques are limitations due to electrical insulation of the substrate. A new method of coating the surface of a substrate is thus needed.

These and other objects, aspects, and advantages of the present disclosure will become better understood with reference to the accompanying description and claims.

SUMMARY

The disclosure provides a method for coating on a plurality of substrate particles utilizing dissolution and deposition processes occurring among a plurality of source particles. The plurality of source particles and the plurality of substrate particles are freely immersed in an aqueous solution to form a slurry, and a pH of the aqueous solution and the electrochemical potential between the plurality of source particles and the aqueous solution establishes the source particles at a corrosion potential providing for concurrent dissolution and re-deposition of a cationic species on the source particles. Agitation of the slurry generates close proximity between source and substrate particles causing substrate particles pass through the local environment of the source particles, resulting in some portion of the cationic species depositing at nucleation sites on the substrate particles.

In the local proximity of a source particle during the process, dissolution of the source particle comprising the coating material generates a local environment having a high concentration of cationic species which decreases as distance from the surface of the source particle increases. The local environment additionally provides conditions amenable to concurrent dissolution and re-deposition on the source particle as earlier described. As a result, a substrate particle comprising low energy nucleation sites which passes in close proximity to a source particle in this state is additionally subject to the higher concentration gradient around the source particle and the local environment, and some part of the cationic species of the coating material deposits on the low energy nucleation sites provided by the substrate particle. Agitation of the slurry acts to drive this close proximity and further provides constant relative motion between a given source particle and a given substrate particle to avoid agglomeration.

A primary advantage of the method disclosed is the ability to provide a coating of a material on substrate particle comprising a dissimilar, non-equivalent material, and non-conductive materials without the necessity of utilizing an electrode to provide the necessary electrical potential typically required in plating operations. For example, utilizing the method, metallic coatings may be generated on generally non-metallic substrates such as carbon, ceramics, polymers, and other dissimilar materials.

The novel method and principles of operation are further discussed in the following description.

Figure 1:
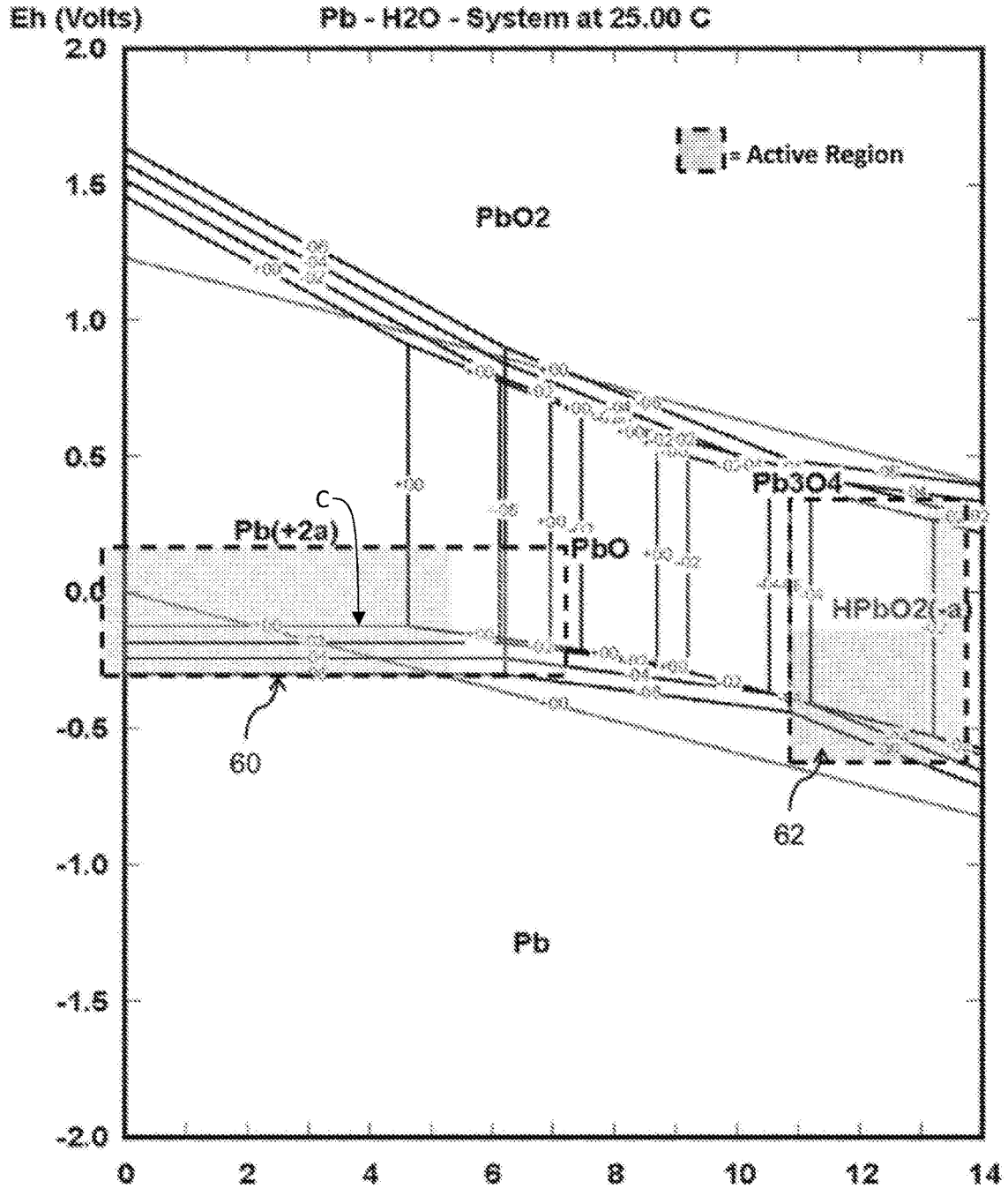
FIG. 1 illustrates a Pourbaix diagram depicting Pb in an aqueous solution.

Embodiments in accordance with the invention are further described herein with reference to the drawings.

DETAILED DESCRIPTION OF THE INVENTION

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide an electroless plating process for producing a coating on a plurality of substrate particles using agitation of a slurry comprising an aqueous solution, a plurality of source particles, and the plurality of substrate particles.

The disclosure provides an electroless plating process for generating a plurality of coated substrate particles using agitation of a slurry comprising an aqueous solution, a plurality of source particles, and a plurality of substrate particles. The conditions of the aqueous solution generate a local environment around the source particles wherein concurrent dissolution and re-deposition of a cationic species occur, and the agitation brings substrate particles within this local environment enabling deposition of some portion of the cationic species on low energy nucleation sites comprising the substrate particles. In contrast to existing additive manufacturing approaches, the exemplary coating process can significantly reduce manufacturing costs by limiting the amount of energy used to achieve the desired coating. While current additive manufacturing/coating technologies are based on the localized sintering, melting, evaporating or electrodeposition of a material, the exemplary method utilizes naturally occurring internal electrochemical potentials to drive the coating process. In contrast to sintering-dissolution, direct foaming, melt coating or vapor deposition processes, for example, the electrochemically driven deposition does not require high temperatures for deposition. Further, the apparatus used in the process may be far less complex as compared to, for example, laser-based systems, allowing for substantial reductions in equipment and operating costs. Additionally, present method allows plating onto a non-conductive substrate. This provides an advantage over known electroplating processes that use electric current to reduce dissolved cations so that they form a coherent coating on an electrode. Thus, the present process allows for formation of coatings onto semiconductive or insulating substrates. As a result, the present method does not require an external cathode and thus facilitates coating of substrates such as small particles which would prove difficult to employ as a cathode.

Generally, the disclosure provides a method for providing a coating on a plurality of substrate particles utilizing dissolution and deposition processes occurring among a plurality of source particles. In brief, the plurality of source particles comprise a coating material, are freely immersed in an aqueous solution comprising an oxidizing agent. Here "freely immersed" means that an individual particle in the plurality of source particles is in contact with the aqueous solution and is unencumbered to move in any direction in the aqueous solution in response to a hydrodynamic force exerted on the individual particle by the aqueous solution, or a mechanical force generated by contact with another particle. Additionally, the plurality of source particles comprises a first group of low energy nucleation sites. The first group of low energy nucleation sites typically comprise small-scale imperfections of surface texture on individual particles which arise through particle collision, manufacturing techniques, inherent material structure, or otherwise. Additionally and significantly, a pH of the aqueous solution and an electrochemical potential between the plurality of source particles and the aqueous solution is established such that the source particles assume a corrosion potential and generate cationic species in the aqueous solution, where the cationic species comprise the coating material comprising the source particles and intended to subsequently comprise the coating of the plurality of substrate particles. The pH of the aqueous solution and the electrochemical potential between the plurality of source particles and the aqueous solution is additionally maintained such that some portion of the cationic species of the coating material are reduced and deposit on the first group of low energy nucleation sites comprising the plurality of source particles.

Maintaining a pH and an electrochemical potential between a surface and an aqueous solution such that corrosive dissolution of the metal to generate cationic species and concurrent electrochemical re-deposition of some of the cationic species back onto the metal at nucleation sites is known in the art. See e.g., Johannes, "Letting Corrosion Work for You: Novel Pathways to Additive Manufacturing and Nanomaterial Synthesis Using Electrochemically-Driven Powder Consolidation," *Advanced Engineering Materials* (2014); see also U.S. Pat. No. 9,248,501 issued to Johannes et al., issued Feb. 2, 2016. Generally and without being bound by theory, concentration gradients may result from localized variations in the dissolution rate and/or from mass transport limitations in confined spaces, and re-deposition of ions such as metal ions may occur in the presence of a reducing agent, such as metal from a different location on the particle surface and/or adsorbed $H_2$ remaining from the corrosion stage. The re-deposition may be governed by multiple mechanisms, including localized equilibrium imbalances dominating the oxidation-reduction reactions, and supersaturation in the local neighborhood of the particle driven by continued dissolution of the metal. In the presence of local nucleation sites, which are subject to lower surface energy, a resulting supersaturation driven by introduction of the nucleation site into the local environment acts to drive a very rapid, localized re-deposition of the metal onto the metal surface.

Within this disclosure, pH and electrochemical conditions are established to provide concurrent dissolution and re-deposition on the plurality of source particles as discussed above, and plurality of substrate particles is additionally added to the aqueous solution. This generates a slurry comprising the aqueous solution, the plurality of source particles, and the plurality of substrate particles. Similar to the plurality of source particles within the slurry, the plurality of substrate particles are freely immersed in the aqueous solution. Additionally, the plurality of substrate particles comprises a second group of low energy nucleation sites, which may generally arise through particle collision, manufacturing techniques, surfactant application, inherent material properties, or otherwise. The resulting slurry is agitated through mechanical means, insonification, or some other method, in order to generate close proximity between the plurality of substrate particles and the plurality of source particles.

In the local proximity of a source particle during the process, dissolution of the source particle comprising the coating material generates a high local concentration of cationic species of the coating material which decreases as distance from the surface of the source particle increases, due to diffusion of the cationic species into the bulk of the aqueous solution following dissolution. Additionally, the local environment surrounding the source particle is amenable to concurrent dissolution and re-deposition on the low energy nucleation sites of the source particle as earlier described. As a result, a substrate particle comprising a second group of low energy nucleation sites which passes in close proximity to and/or making brief contact with a source particle in this state is additionally subject to the higher concentration gradient around the source particle and the local environment driving the re-deposition process. As a result, some part of the cationic species of the coating material will deposit on the second group of low energy nucleation sites provided by the substrate particle passing through that local environment. Agitation of the slurry as previously described acts to drive individual substrate particles into close proximity of one or more individual source particles, facilitating re-deposition on the individual substrate particle and ultimately coating the substrate particle with a coating comprising the coating material. Agitation further and significantly provides constant relative motion between a given source particle and a given substrate particle, so that the substrate particle passes through the dissolution/re-deposition region surrounding the source particle and avoids any static relative orientations between source and substrate particles that could lead to agglomeration. When some degree of coating has been achieved, the plurality of coated substrates are separated from the slurry using some means known in the art, such as a centrifuge, a sieve, a filter, a gravity separator, or some other means.

A primary advantage of the method disclosed is the ability to provide a coating of a material on substrate particle comprising a dissimilar, non-equivalent material, without the necessity of utilizing an electrode to provide the necessary electrical potential typically required in plating operations. For example, utilizing the method, metallic coatings may be generated on generally non-metallic substrates such as carbon, ceramics, polymers, and other dissimilar materials. Generally, the method is useful for providing a coating of a first material on substrate particles which largely comprise a second material fundamentally different from the first material. In a particular embodiment, the coating material of the method comprises at least 50 wt. % of a first material having a first composition, and the cationic species of the coating material generated is an ionic species of a constituent of the first composition, and the plurality of substrate particles comprise less than 20 weight percent (wt. %), less than 10 wt. %, or less than 5 wt. % of the first material, so that the coated substrate particles have a coating composition fundamentally distinct from a majority composition of the bulk matter deeper within the substrate particles themselves. In a another embodiment, the coating material of the method comprises at least 50 wt. % of a first element, and the cationic species of the coating material generated is an ionic species of the first element, and the plurality of substrate particles comprise less than 20 wt. %, less than 10 wt. %, or less than 5 wt. % of the first element. In a further embodiment, the first element is a first metal and a composition of the substrate particles comprise less than 20 wt. %, less than 10 wt. %, or less than 5 wt. % of the first metal.

The coating material comprising the plurality of source particles may be any material where the pH and electrochemical conditions described may be established to generate cationic species of the coating material in the aqueous solution and concurrent re-deposition of some portion of the cationic species back on the plurality of source particles comprising the coating material. The coating material may be any coating material that has a standard redox potential in a range that forms ions in aqueous media. The coating material may be a metal, semi-metal or non-metal coating material, or an alloy or mixture comprising combinations therein. Examples of metallic coating materials include transition metals and metals of groups XIII-XVI of the periodic table. Examples of suitable metals of group XIII include aluminum, gallium, indium, and thallium. Examples of suitable metals of group XIV include germanium, tin, and lead. Examples of suitable metals of group XV include antimony, and bismuth. Examples of suitable metals of group XVI include polonium. For convenience, metalloids such as silicon, germanium, antimony, and tellurium, are considered as metals in the following description and claims. Semi-metals that can be used in the present process include, for example, silicon and tellurium. A non-metal that can be used in the present process includes, for example, phosphorus.

Additionally, as used here, "aqueous solution" means a solution in which the solvent is water. The aqueous solution may comprise any solute, such as solutes intended for control of pH or the electrochemical potential between the plurality of source particles and the aqueous solution. The aqueous solution may also operate in the presence of agents such as hydrogen peroxide, vanadium oxide, or other substances intended for control of the process.

Similarly, "oxidizing agent" means a chemical species which undergoes a chemical reaction that removes one or more electrons from an atom comprising a source particle. In certain embodiments, the oxidizing agent comprises hydrogen ions, oxygen, and combinations thereof.

Similarly, "cationic species" means an ion with net positive charge where the ion comprises the coating material comprising the source particle. Within this disclosure, the source particles assume a corrosion potential and provide cationic species which diffuse into the aqueous solution.

Similarly, "corrosion potential" means the potential assumed by a source particle freely immersed in the aqueous solution and experiencing oxidation and reduction currents where $\Sigma I_a+\Sigma I_c=0$, where $I_a$ is an oxidation current and $I_c$ is a reduction current. See e.g., E. Stansbury and R. Buchanan, *Fundamentals of Electrochemical Corrosion* (2000), among many others.

Similarly, "close proximity" refers to a distance between a source particle and a substrate particle sufficient to subject the substrate particle to cationic species generated through dissolution of the source particle. In some embodiments, close proximity refers to a distance between a source particle and a substrate particle sufficient to place the source particle within the electrical double layer of the substrate particle. The thickness of the electrical double layer surrounding a substrate particle may be determined using means known in the art. See e.g Zbigniew Stojak, *The Electrical Double Layer and Its Structure*, in Electroanalytical Methods: Guide to Experiments and Applications (Fritz Sholz ed. 2002); see also IUPAC, *Compendium of Chemical Terminology,* 2nd ed. (the "Gold Book") (1997); and see Wang et al., "Accurate Simulations of Electric Double Layer Capacitance of Ultramicroelectrodes," *J. Phys. Chem. C* 115 (2011), among others. In a particular embodiment, the source particle has a mean diameter $D_1$, and close proximity connotes a distance less than 100 times $D_1$, and in an embodiment less than 25 times $D_1$. In other embodiments, close proximity means a distance less than 100 micron, less than 1 micron, less than 500 nanometer, or less than 100 nanometer. In some embodiments, close proximity means contact however intermittent between the source particle and the substrate particle. Evaluation of the proximity by which a substrate particle passes through the local environment of a source particle under given conditions of agitation can be determined using means known in the art, for example, particle image velocimetry. See e.g., R. Markus et al., *Particle Image Velocimetry: A Practical Guide* ($2^{nd}$, 1998), among others.

The agitation may be provided by any means sufficient to generate relative motion between the plurality of source particles and the plurality of substrate particles such that a given substrate particle passes through the dissolution/redeposition region surrounding a given source particle while avoiding static relative orientations that could lead to agglomeration. For example, agitation may be provided using methodologies employing impellers, pumps, fluid jets, ultrasonic transducers, shaking, or any other method sufficient to provide relative motion between source particles and substrate particles as described. In a particular embodiment, the agitation provides at least on-bottom motion as that term is used in the art, such that all source particles and all substrate particles are in motion, either suspended or with some horizontal velocity on a tank bottom. See e.g. N. P. Brown and N. I. Heywood, *Slurry Handling: Design of solid-liquid systems* (1991); see also E. L. Paul et al., *Handbook of Industrial Mixing: Science and Practice, Volume* 1, (2004), among many others. Generally the slurry may have any volume percent solids sufficient to enable the process as described. In an embodiment, the slurry has a volume percent solids of greater than or equal to 1% and less than or equal to 70%, where the volume percent solids is equal to $V_{solid}/V_{slurry}$ multiplied by 100%, where $V_{solid}$ is the volume of source particles and the volume of substrate particles, and $V_{slurry}$ is the volume of slurry. Additionally, the volume ratio of substrate particles to source particles may be any value sufficient to enable the process as described. In a particular embodiment, the volume ratio is greater than or equal to 0.01 and less than or equal to 100, where the volume ratio is equal to $V_{substrate}/V_{source}$, where $V_{substrate}$ is the volume of substrate particles in a given volume of slurry and $V_{source}$ is the volume of source particles in the given volume of slurry.

As is understood, dissolution occurs as a result of oxidation of a surface to form water soluble metal ions. The process can be controlled by varying the temperature, potential, and concentration of hydrogen ions (acidity) and hydroxide ions (alkalinity). Suitable conditions to be used can be determined from the Nernst Equation:

$$E - E^0 - \frac{RT}{nF}\ln\frac{(V_R^{V_R})}{C_0^{V_0}} \tag{1}$$

where E is the open current potential, $E^0$ is the open current potential at steady state, R is the gas constant, T is absolute temperature in Kelvin (K), n is the number of electrons exchanged in the chemical reaction, F is Faraday's constant, $C_R^{v_R}$ is the concentration of the reduced species at the surface, and $C_O^{v_o}$ is the concentration of the oxidized species at the surface. In an exemplary reaction of solid lead to plumbous ion ($Pb^{2+}$) in the acidic region, the Nernst equation becomes:

$$E = E^0_{Pb\to Pb^{2+}} - \frac{RT}{2F}\ln[Pb^{2+}] \tag{2}$$

This assumes a chemical activity of 1 for solids and liquids. As an example, for the reaction of solid lead to biplumbite ion ($HPbO_2^-$) in an alkaline region, the Nernst equation becomes:

$$E = E^0_{Pb\to HPbO_2} - \frac{RT}{2F}\ln\{[HPbO_2^-][H^+]^3\} \tag{3}$$

In some embodiments, suitable pH and potential ranges may be determined prior to immersion of the source particles in the aqueous solution. Suitable ranges for these parameters may also be determined empirically. Alternatively, a suitable operating region for the process may be determined by consulting existing potential-pH equilibrium diagrams for the base element(s). The regions where solid oxide films are formed should generally be avoided due to the surface of the source particles potentially becoming resistant to the dissolution of the coating material.

Figure 2:
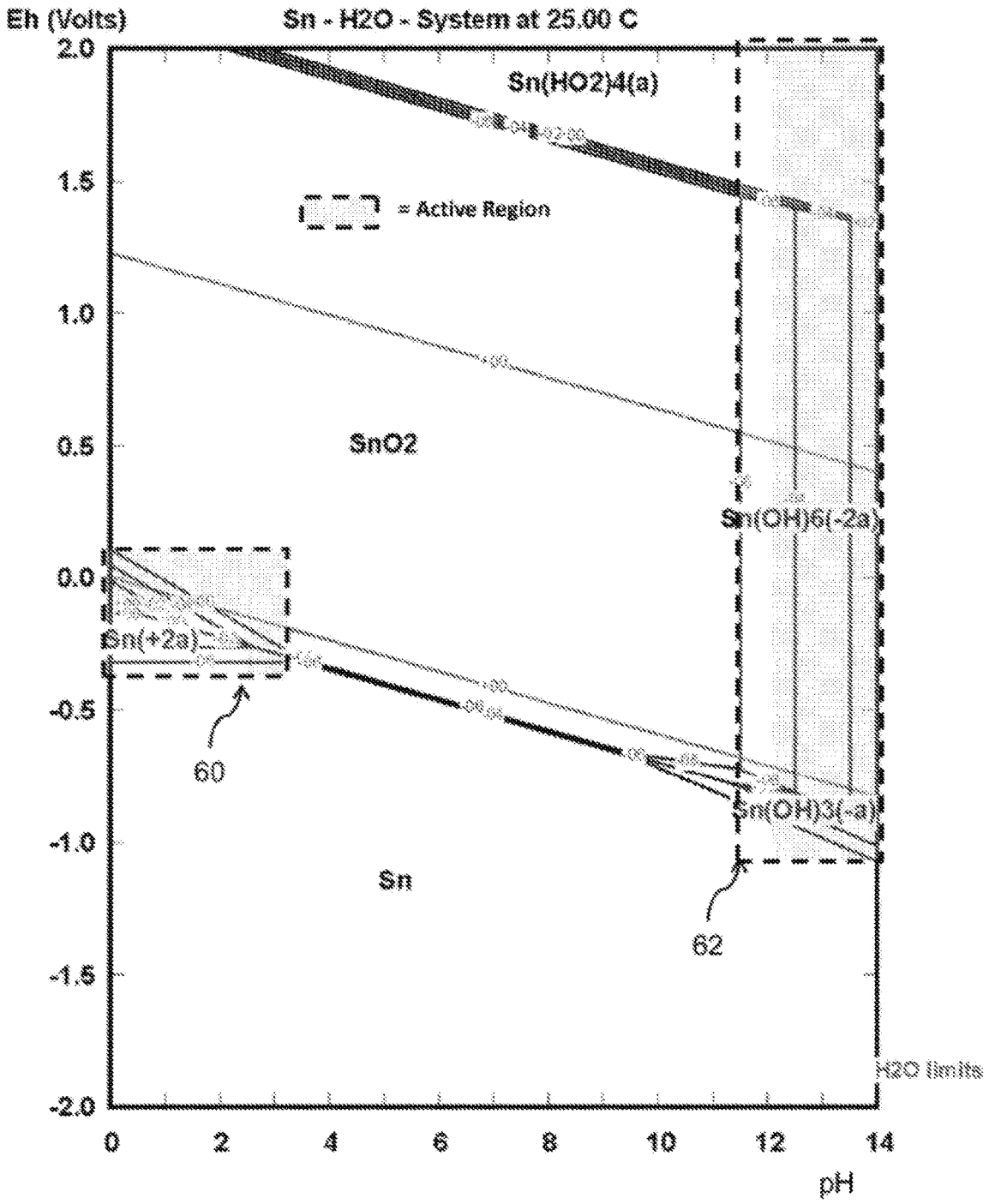
FIG. 2 illustrates a Pourbaix diagram depicting Sn in an aqueous solution.

By way of example, FIG. 1 shows the potential-pH equilibrium diagram (Pourbaix diagram) with operating regions for lead in water at 25° C. The basic plot was obtained from Pourbaix, M. in *Atlas of Electrochemical Equilibria in Aqueous Solutions*, in Franklin J. A. (Ed.), Second English Edn (National Association of Corrosion Engineers, 1974, hereinafter, "Pourbaix 1974"). The plot has been adapted to show suitable active regions 60 and 62, which are acid and alkaline respectively, in which both lead metal and lead ions are able to coexist. In particular, a suitable operating region for use in acid conditions employs a potential of from +0.1 E(V) to −0.3 E(V) and a pH of from −2 to +6.5, or 0 to 6. A suitable operating region for use in alkaline conditions employs a potential of from +0.3 E(V) to −0.7 E(V) and a pH of from +14 to +16. Different local concentrations of ions may result in local potential changes such that one part of the surface of the particles may be subject to conditions in the region of the Pourbaix diagram (above line C) in which $Pb^{2+}$ is favored while another part of the surface may be subject to conditions in the region (below line C) where Pb is favored, such that deposition and dissolution can occur contemporaneously at different locations. FIG. 2 shows an analogous plot for tin-water at 25° C., based on Pourbaix 1974, p. 479.

For different temperatures, different regions will be appropriate. For example, a three dimensional Pourbaix diagram can be generated which has temperature as a third dimension for identifying a suitable acid or alkaline region at a given temperature.

In the acidic region, for example, hydrogen ions and dissolved oxygen are typically the two main oxidizing agents. As an example and using the case of lead, the following oxidation/reduction reactions are believed to take place:

$$2Pb+O_{2(g)}+2H_2O_{(l)}\rightarrow 2Pb_2{+}{+}4OH^- \text{ (−1.06 V @ 20° C.)} \quad (4)$$

$$Pb+2H^+\rightarrow Pb^{2+}+H_{2(g)} \text{ (−0.12V @ 20° C.)} \quad (5)$$

In the case of alloys, the Pourbaix diagram for one of the constituent metals in the alloy may be selected to determine an appropriate operating region. In an embodiment, the aqueous solution comprising cationic species of the coating material is provided by contacting the plurality of source particles with an acidic solution or a basic solution to generate the aqueous solution comprising the desired cationic species. In another embodiment, the deposition on the plurality of substrate particles can be repeated to produce a multi-layer coating by a multi-stage, electrochemically-driven deposition process. Generation of the cationic species of the coating material typically begins with an oxidation step involving contacting surfaces of the plurality of source particles with an acidic solution or a basic solution to generate the aqueous solution and cationic ions.

The source material for providing the ion may be in any form and shape of a solid material, including a powder. In some embodiments, the plurality of source particles may be predominantly (over 50 wt. %) coating material, such as at least 60 wt. %, or at least 80 wt. %, or at least 90 wt. %, or at least 99 wt. % or at least 99.999 wt. % of coating material. Additionally, the coating material present may be predominantly in elemental form, rather than in an oxidized or reduced form, i.e., over 50 wt. % of the coating material in the powder and/or the formed body are in the elemental phase, such as at least 60 wt. %, or at least 80 wt. %, or at least 90 wt. %, and in some embodiments up to 99 wt. % or 99.999 wt. %. In other embodiments, the coating material need not be in elemental form. Rather, if the stability of the selected material is suitable, as indicated by for example a relevant Pourbaix diagram, and the pH is set properly, the source material that provides the ions could be in the form of oxides or hydroxides. In one embodiment, the surface of the source particles are free of an oxide layer.

During the agitation step, substrate particles are contacted with the aqueous solution of ions. The substrate particles are brought into close proximity with surface of one or more source particles, such that exposure of the substrate particles to the cationic species may be achieved by mass transport of the aqueous solution from the surface of the source particle to the substrate particles. In some embodiments, the substrate particles comprise a powder. Typically in the aqueous solution within the close proximity of a source particle, the concentration of cationic species is maintained at high levels, such that locally the aqueous solution is nearly saturated, saturated, or supersaturated with the cationic species of the coating material. When a substrate particle is contacted with the aqueous solution surrounding a source particle, the ions in the solution are reduced in the presence of the second group of low energy nucleation sites comprising the substrate particle and coat onto the substrate particle. Here the term "saturated" indicates that the aqueous solution comprising the ion can dissolve no more of that and additional amounts of it will appear as a separate phase, and the term "supersaturated", or "supersaturation" refers to a state of the aqueous solution that contains more of the dissolved material than can be dissolved by the solvent. Supersaturation may be achieved, for example, when a condition of a saturated aqueous solution containing the ion is changed such that the solubility limit is reduced. Thus, supersaturation may be achieved, for example, by introduction of a substrate particle having low energy nucleation sites into the environment, by decreasing temperature, by decreasing volume of the saturated solvent, or by increasing pressure of a saturated solution of ions. The deposition of coating material on the substrate surface is favored at higher ion concentrations in the aqueous solution as well as by substrates having lower nucleation energy levels. After coating and separation, additional post-treatment steps may be carried out such as one or more steps selected from cleaning, sintering, polishing, further shaping, and the like.

The source particles may further be a solid in any form and shape. Examples of forms and shapes of source particles include powders, nanopowders, spherical powders, flakes, sponge, shot, turning, slugs, foils, discs, plates, wire and rods. A high surface area fine powder may be preferred. The powder may be provided by, for example, milling (mechanical alloying), such as ball milling, and/or sieving to provide a desired particle size distribution. The particle size can be controlled by powder grinding methods, such as high energy ball milling and/or cryogenic milling. In some cases, an as-received powder may be sufficiently finely divided that further size reduction is not needed.

By way of example, the average particle size (mean particle diameter) of the source particles in a powder following grinding or some other pretreatment process (if any), may be less than 200 μm (microns), e.g., less than 100 μm, or less than 80 μm, or less than 50 μm, or less than 30 μm and may be at least 0.2 μm or at least 1 μm, as determined by dynamic light scattering according to the Horiba Instruments Scientific White paper WP004, entitled Sampling for Particle Size Analysis (Online: http://www.horiba.com/scientific/products/particle-characterization/downloadcenter/white-papers/, 2012). Similarly, the average particle size (mean particle diameter) of the substrate particles following grinding or some other pretreatment process (if any), may be less than 200 μm (microns), e.g., less than 100 μm, or less than 80 μm, or less than 50 μm, or less than 30 μm and may be at least 0.2 μm or at least 1 μm. The plurality of source particles and the plurality of substrate particles may have a particle size distribution which can be mono, bi- or multi-modal.

In some embodiments, immersing the plurality of source particles in the aqueous solution may be carried out in the presence of the plurality of substrate particles. Additionally, the plurality of source particles and the plurality of substrate particles may be mixed together, and/or may optionally be ground together.

The temperature, dissolved oxygen, particle flow rate, pH and surface potential of the source particles may be adjusted or controlled when generating the solution of cations. Techniques such as sonic/ultrasound agitation, mechanical stirring, shaking, and other mechanisms that cause movement of the acid or base around the surface containing the coating material may be employed.

The temperature of the solution can be controlled using an external heat source, such as a heating mantle, hot plate, and/or heating tape. The temperature can be maintained at less than 100° C., such as less than 50° C., or less than 40° C., and in one embodiment, at least 10° C., or at least 20° C. In some embodiments, the liquid is added at a desired temperature. In other embodiments, no heating is needed.

The pH of the aqueous solution can be controlled by adjusting the concentration of $H^+$ and/or $OH^-$ ions in the solution by, for example, addition of acidic and/or alkaline substances and/or adjusting the rate at which these substances are added. As examples, inorganic acids such as sulfuric and nitric acids, or metal hydroxides, such as sodium and potassium hydroxides, may be used as acidic and alkali substances, respectively. The required concentration of the acid (or base) may be dictated by the Pourbaix diagram of the material to be dissolved. In some methods, the concentration of the acid may be, for example, at least 2M, or at least 4M. An acidic aqueous solution may comprise any acid having sufficient strength to generate the required pH, but is typically a strong acid. Examples of an acid that may be used according to the present invention include hydroiodic acid, hydrobromic acid, perchloric acid, hydrochloric acid, sulfuric acid, p-toluenesulfonic acid, methanesulfonic acid, nitric acid, chloric acid, bromic acid, perbromic acid, iodic acid, periodic acid and mixtures thereof. Similarly, a basic aqueous solution may comprise any base of sufficient strength to provide the desired pH and is preferably a strong base. Examples of bases that may be used according to the present invention include potassium hydroxide, barium hydroxide cesium hydroxide, sodium hydroxide, strontium hydroxide, magnesium hydroxide, calcium hydroxide, lithium hydroxide, rubidium hydroxide, and mixtures thereof.

The plurality of substrate particles may comprise any material providing a second group of low energy nucleation sites, as discussed. The low energy nucleation sites are required for the coating material to preferentially coat onto the substrate particles rather than migrating away or precipitating from the solution. Skilled persons are familiar with suitable materials that have the required low energy nucleation sites. The plurality of substrate particles may comprise, for example, particles of fine powders, micropowders and nanopowders. In certain embodiments, such powders may comprise more than 50% carbon, or more than 68% carbon, or more than 95% carbon, or more than 99.7% carbon, or more than 99.99% carbon, and may include a material selected from carbon black, graphite powder, carbon nanotube, graphene powder, carbon onions, graphene nanoribbons and nanocrystalline graphite. Exemplary carbon nanotubes have an average length of less than 1000 nm or less than 100 nm in their longest dimension, and optionally at least 90% of the nanotubes have a length of less than 100 nm or 200 nm in their longest dimension.

The pH of the aqueous solution comprising the ions and the electrochemical potential for the reduction of the coating material each play a role in the coating step. The selection of a suitable pH and potential will influence the coating process. Such a selection may, for example, be made by consulting a Pourbaix diagram. A Pourbaix diagram, maps the stable phases of an aqueous electrochemical system.

The surface potential is maintained in a range at which local differences in surface potential allow deposition of coating material onto the substrate substantially contemporaneously with reduction of the dissolved ions to the corresponding material. The potential can be kept in this range by the addition of potential-control agents, such as hydrogen peroxide and vanadium oxide. The surface potential can also be regulated by addition of surfactants, such as Rhodamine B. The method generally relies on a redox reaction and does not require energy input, such as an electric current, which is conventionally used in electrodeposition processes.

Additionally, the concentration of dissolved oxygen can be controlled by adding/removing oxygen to/from the aqueous solution. For example, the aqueous solution can be oxygenated with an oxygen/air bubbler, or, alternatively, at least some of the dissolved oxygen in the aqueous solution can be displaced by an inert gas, such as argon or nitrogen. In one embodiment, the oxygen concentration of the aqueous solution is less than 50% of the saturation point. The percent saturation defined as a measured concentration of the dissolved oxygen divided by the maximum oxygen the liquid can dissolve at the measurement temperature. For example, at 25° C., the dissolved oxygen concentration in the contacting liquid may be about four ppm or less.

The surface of a resulting coated substrate may be at least 50%, or at least 80%, or at least 90% coating material, and can be up to 99 or 100% coating material, where 100% coating material denotes a complete coating of the entire surface. In an exemplary case where a powder is combined with a solid material, such as carbon nanotubes, the resulting product may contain at least 50 wt. %, or at least 80 wt. %, or at least 90 wt. % coating material.

The method may be conducted at any suitable temperature, and preferably is conducted at 20-30° C. or near ambient pressure and temperature. The coating can be formed at a temperature significantly less than the melting point of the coating material. Typically, the present process is carried out at temperatures of less than 50° C. This avoids the need to provide a large amount of energy for the process.

Figure 3:
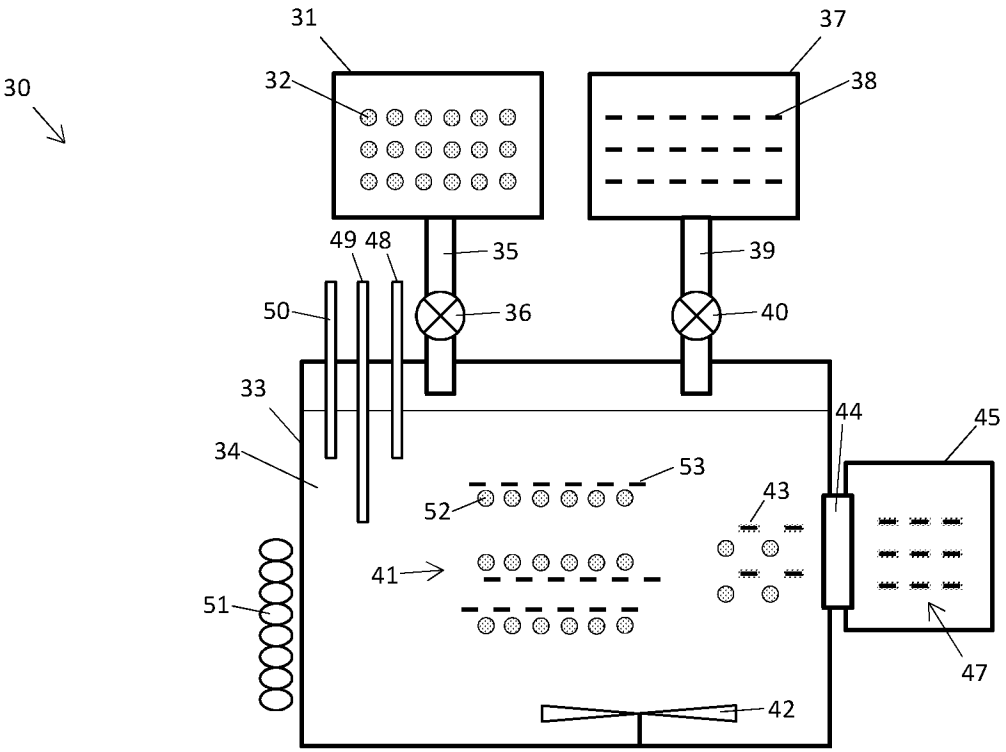
FIG. 3 illustrates an apparatus for conduct of the method disclosed.

FIG. 3 illustrates an exemplary apparatus 30 for conduct of the method disclosed. A first hopper 31 contains a plurality of source particles such as source particle 32, and is connected to mixing vessel 33 holding aqueous solution 34 through pipe 35 comprising valve 36. The plurality of source particles 32 comprises a coating material, such as a metal, and aqueous solution 34 comprises an oxidizing agent, such as $H^+$. Similarly, a second hopper 37 contains a plurality of substrate particles such as substrate particle 38, and is connected to mixing vessel 33 holding aqueous solution 34 through pipe 39 comprising valve 40.

Apparatus 30 delivers a plurality of source particles such as 52 to mixing vessel 33 such that the plurality of source particles 52 are freely immersed within aqueous solution 34 of mixing vessel 33. Aqueous solution 34 has a pH and establishes an electrochemical potential with the plurality of source particles 52 such that the plurality of source particles 52 assume a corrosion potential and generate a cationic species of the coating material in the aqueous solution. The pH of aqueous solution 34 and the electrochemical potential between the plurality of source particles 52 and aqueous solution 34 are maintained in ranges allowing some portion of the cationic species to reduce and deposit on a first group of low energy nucleation sites comprising the plurality of source particles 52. Apparatus 30 additionally delivers a plurality of substrate particles such as 53 to mixing vessel 33, and plurality of substrate particles 53 are freely immersed within aqueous solution 34 of mixing vessel 33. The plurality of source particles 52, the plurality of substrate particles 53, and aqueous solution 34 combine to form slurry 41 in mixing vessel 33.

An agitator such as an impeller, pump, fluid jet, ultrasonic transducers, a shaker, or some other means provides agitation to slurry 41. At FIG. 3, a mechanical impellor 42 agitates slurry 41 and generates close proximity between the plurality of source particles 51 and the plurality of substrate particles 52. As discussed, the action of impellor 42 drives the plurality of substrate particles 53 through the high concentration of cationic species within local environment of the source particles undergoing the dissolution/re-deposition process. As a result, some part of the cationic species of the coating material deposit on a second group of low energy nucleation sites comprising the substrate particle. The continued agitation additionally acts to provide constant relative motion between a given source particle and a given substrate particle, so that substrate particles pass through the dissolution/re-deposition regions surrounding the source particles and avoids static relative orientation that could lead to agglomeration. This process generates a plurality of coated substrates such as 43. When some degree of coating has been achieved, the plurality of coated substrates 43 are separated from slurry 41 using a separator such as sieve 44, and coated substrates 47 are collected in collection vessel 45.

The method may be conducted in an apparatus such as apparatus 30 either as a batch process where additions and agitations cease as the plurality of coated substrates is separated, or as a continuous process whereby additional source particles and substrate particles are added as necessary while the separating means continuously removes coated substrates from the slurry. The apparatus may additionally comprise additional instrumentation, such as temperature sensor 48, $O_2$ sensor 49, pH sensor 50, and heater 51 for facilitation of temperature control, pH control, $O_2$ control, and control of other impacting parameters within mixing vessel 33.

In some embodiments, oxidation and dissolution of the coating material occurs by hydrogen ions and dissolved oxygen that serve as oxidizing agents, creating ions on the surface of the source particles. Corrosion occurs when the surfaces are exposed to an electrolyte solution. The exact mechanism and reaction kinetics strongly dependent on the chemical and physical environment of the surface. For example, in the acidic pH region, hydrogen ions (H+) and dissolved oxygen ($O_2$) are the two main oxidizing agents causing the dissolution of exposed metal (M) surfaces according to:

$$\text{Anodic Reactions: } 2H^+ + 2e^- \rightarrow H_{2(g)} \text{ 0 V vs NHE} \quad (9)$$

$$O_{2(g)} + 4H^+ + 4e^- \rightarrow 2\,H_2O_{(l)} \text{ 1.23 V vs NHE} \quad (10)$$

$$\text{Cathodic Reaction: } M \rightarrow M^{x+} + xe^- \quad (11)$$

The listed voltages are the standard redox potentials with respect to the normal hydrogen electrode (NHE). In many cases, the dissolved cations ($M^{x+}$) are transported away from the surface, form a salt with anions in the electrolyte, and precipitate out of the solution. However, under certain conditions, a re-deposition of the cationic species can occur, even without a change in temperature.

The hydrogen ions form hydrogen gas that is adsorbed onto the surface of the particles and remains present at the surface participating in future reactions. (see, Marsalek, R. The Reduction of Zinc using Goethite Process and Adsorption of $Pb^{+II}$, $Cu^{+II}$ and $Cr^{+III}$ on Selected Precipitate. *Intern 'I J. Environmental Sci. and Oev't* 2 (4) 255-258 (2011)).

The cationic species are susceptible to re-deposition depending on the reaction kinetics and surface conditions. For the re-deposition to occur, a reducing agent is needed. Exemplary reducing agents material such as metal from a different location on a source particle or adsorbed hydrogen gas from the corrosion stage. For example, using Pb:

$$Pb^{2+} + H_{2(g)} \rightarrow Pb + 2H^+ \text{ 0.12V @ 20° C.} \quad (12)$$

Using either reducing agent, localized equilibrium imbalances drive the oxidation/reduction reaction.

Ion transport in a static system without agitation is driven by diffusion and electrostatic migration and will eventually come to a steady state allowing for the total system to come to equilibrium. When the fluid is in motion, as with the case of agitation, advection increases mass transport and changes the equilibrium chemical kinetics. This coupled with the difference in supersaturation and surface energy between particles drives the coating process. Over time, the process will cease when the dissolved ion concentration on the surface of the agglomerates reaches equilibrium at some critical size ($d_{critical}$). Additionally, the presence of anions in the solution has the potential for the ions to form insoluble salts. Salt formation can cause surface films on the particles or consume and precipitate the ions out of the solution resulting in the suppression of the process (see, Pourbaix). In the case of Pb in sulfuric acid, the formation of $PbSO_4$ tends to stifle the re-deposition process.

$$Pb^{2+} + SO_4^- \rightarrow PbSO_4 \text{ −0.26 V @ 20° C.} \quad (13)$$

Sulfuric acid in the four to six molar concentration range works well due to the multiple dissociation reactions that occur for the release of hydrogen ions (Danel, V. et al. Study of Pb(ll) in various $H_2O$—$H_2SO_4$ mixtures by differential pulse polarography: Solubility of lead sulfate, diffusion-coefficient of Pb(ll) and half-wave potential of Pb(Hg)/Pb (II). *Electrochim. Acta* 27, 771-774 (1982)). At 20° C., the first dissociation is strong and has a reaction potential of −0.68 volts; however, the second dissociation reaction is weak with a positive reaction potential of 0.11 volts.

$$H_2SO_4(l) \rightarrow H^+ + HSO_4^- \text{ −0.68 V @ 20° C.} \quad (14)$$

$$HSO_4^- \rightarrow H^+ + SO_4^{2-} \text{ 0.11 V @ 20° C.} \quad (15)$$

The result of the multiple dissociations is a high initial concentration hydrogen and bisulfate ($HSO_4^-$) ions for the corrosion of the Pb and a low concentration of sulfate ions for $PbSO_4$ formation. Over time, $PbSO_4$ will form if the system reaches equilibrium; however, the kinetics are relatively slow as can be seen with the self-discharge of lead-acid batteries.

The surface potential plays a key role in the re-deposition stage and may additionally be controlled using surfactants and potential-control agents, such as hydrogen peroxide or vanadium oxide. Another control mechanism is the amount of dissolved oxygen in the solution. As previously discussed, dissolved oxygen competes with the hydrogen ions for the corrosion of metal surfaces and can have a much greater reaction potential. Temperature may also play a role and can greatly affect chemical reaction kinetics, fluid properties, phase changes, and ionic solubility. Agitation mechanisms such as ultrasonic agitation, stirring, shaking, and others increase particle and ionic mass transport and in addition acts to create an equilibrium imbalance in the local environment of a particle.

Thus, provided here is a method for providing a coating on a plurality of substrate particles utilizing dissolution and deposition processes occurring among a plurality of source particles. The plurality of source particles comprises a coating material and a first group of low energy nucleation sites. Both the plurality of source particles and the plurality of substrate particles are freely immersed in the aqueous solution. The aqueous solution comprises an oxidizing agent, and a pH of the aqueous solution and an electrochemical potential between the plurality of source particles and the aqueous solution establishes the source particles at a corrosion potential where concurrent dissolution and re-deposition of a cationic species occur on the source particles. Agitation of the slurry generates close proximity between the source particles and the substrate particles such that the substrate particles pass through a high concentration of the cationic species within a local environment surrounding the source particles, and some portion of the cationic species deposit at nucleation sites on the substrate particles. Agitation additionally acts to maintain separation between the source particles and the substrate particles. When sufficient deposition on the substrate particles has been achieved, the coated substrate particles are separated from the slurry.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

What is claimed is:

1. A method of producing a plurality of coated substrates using electrochemical potentials generated without the use of an electrode comprising:

immersing a plurality of source particles comprising a coating material with an aqueous solution comprising an oxidizing agent such that the plurality of source particles are freely immersed in the aqueous solution, where the plurality of source particles comprise a first group of nucleation sites;

establishing a pH of the aqueous solution and maintaining an electrochemical potential between the plurality of source particles and the aqueous solution such that the plurality of source particles assumes a corrosion potential and generates a cationic species of the coating material in the aqueous solution, and maintaining the pH of the aqueous solution and the electrochemical potential between the plurality of source particles and the aqueous solution such that some portion of the cationic species of the coating material are reduced and deposit on the first group of nucleation sites comprising the plurality of source particles;

adding a plurality of substrate particles to the aqueous solution and generating a slurry, where the slurry comprises the aqueous solution, the plurality of source particles, and the plurality of substrate particles, and where the plurality of substrate particles comprise a second group of nucleation sites, and further where the slurry has a volume percent solids of greater than or equal to 1% and less than or equal to 70%, where the volume percent solids is equal to $V_{solid}$ divided by $V_{slurry}$ and multiplied by 100%, where $V_{solid}$ is the volume of the plurality of source particles added to the volume of the plurality of substrate particles, and where $V_{slurry}$ is the volume of the aqueous solution added to $V_{solid}$;

agitating the slurry and generating close proximity between the plurality of substrate particles and the plurality of source particles;

depositing another portion of the cationic species of the coating material on the second group of nucleation sites comprising the plurality of substrate particles, thereby producing the plurality of coated substrates; and separating the plurality of coated substrates from the slurry.

2. The method of claim 1 where the coating material comprises at least 50 wt. % of a first material having a first composition, and where the cationic species of the coating material is an ionic species of a constituent of the first composition, and where the plurality of substrate particles comprise less than 20 wt. % of the first material.

3. The method of claim 2 where the first material is a metal.

4. The method of claim 3 where the plurality of source particles and the plurality of substrate particles have a mean particle diameter of less than or equal to 200 microns.

5. The method of claim 4 where the pH of the aqueous solution is less than 7 and where the oxidizing agent comprises H+.

6. The method of claim 5 where the oxidizing agent further comprises $O_2$.

7. The method of claim 4 where the pH of the aqueous solution is greater than or equal to 7.

8. The method of claim 2 where an individual substrate particle in the plurality of substrate particles generate an electrical double layer around the individual substrate particle, and where generating close proximity comprises driving an individual source particle in the plurality of source particles to within the electrical double layer around the individual substrate particle.

9. The method of claim 2 further comprising agitating the slurry to provide at least on-bottom motion such that each source particle in the plurality of source particles and each substrate particle in the plurality of substrate particles is in motion.

10. The method of claim 9 where the slurry has a volume ratio greater than or equal to 0.01 and less than or equal to 100, where the volume ratio is equal to $V_{substrate}/V_{source}$, where $V_{substrate}$ is the volume of the plurality of substrate particles in a volume of slurry and $V_{source}$ is the volume of the plurality of source particles in the volume of slurry.

11. A method of producing a plurality of coated substrates using electrochemical potentials generated without the use of an electrode comprising:

immersing a plurality of source particles comprising a coating material with an aqueous solution comprising an oxidizing agent such that the plurality of source particles are freely immersed in the aqueous solution, where the plurality of source particles comprise a first group of low energy nucleation sites, and where the coating material comprises at least 50 wt. % of a first material having a first composition;

establishing a pH of the aqueous solution and maintaining an electrochemical potential between the plurality of source particles and the aqueous solution such that the plurality of source particles assumes a corrosion potential and generates a cationic species of the coating material in the aqueous solution, where the cationic species of the coating material is an ionic species of a constituent of the first composition, and maintaining the pH of the aqueous solution and the electrochemical potential between the plurality of source particles and the aqueous solution such some portion of the cationic species of the coating material are reduced and deposit on the first group of nucleation sites comprising the plurality of source particles;

adding a plurality of substrate particles to the aqueous solution where the plurality of substrate particles comprise less than 20 wt. % of the first material, and generating a slurry, where the slurry comprises the aqueous solution, the plurality of source particles, and the plurality of substrate particles, and where the plurality of substrate particles comprise a second group of nucleation sites, further where the slurry has a volume percent solids of greater than or equal to 1% and less than or equal to 70%, where the volume percent solids is equal to $V_{solid}$ divided by $V_{slurry}$ and multiplied by 100%, where $V_{solid}$ is the volume of the plurality of source particles added to the volume of the plurality of substrate particles, and where $V_{slurry}$ is the volume of the aqueous solution added to $V_{solid}$, and where the slurry has a volume ratio greater than or equal to 0.01 and less than or equal to 100, where the volume ratio is equal to $V_{substrate}/V_{source}$, where $V_{substrate}$ is the volume of the plurality of substrate particles in a volume of slurry and $V_{source}$ is the volume of the plurality of source particles in the volume of slurry;

agitating the slurry and providing at least on-bottom motion such that each source particle in the plurality of source particles and each substrate particle in the plurality of substrate particles is in motion, and generating close proximity between the plurality of substrate particles and the plurality of source particles;

depositing another portion of the cationic species of the coating material on the second group of nucleation sites comprising the plurality of substrate particles, thereby producing the plurality of coated substrates; and separating the plurality of coated substrates from the slurry.

12. The method of claim 11 where the plurality of source particles and the plurality of substrate particles have a mean particle diameter of less than or equal to 200 microns.

13. The method of claim 12 where the pH of the aqueous solution is less than 7 and where the oxidizing agent comprises H+.

14. The method of claim 13 where an individual substrate particle in the plurality of substrate particles generate an electrical double layer around the individual substrate particle, and where generating close proximity comprises driving an individual source particle in the plurality of source particles to within the electrical double layer around the individual substrate particle.

* * * * *